US010826193B2

(12) United States Patent
Kim et al.

(10) Patent No.: US 10,826,193 B2
(45) Date of Patent: Nov. 3, 2020

(54) ANTENNA MODULE INCLUDING A FLEXIBLE SUBSTRATE

(71) Applicant: SAMSUNG ELECTRO-MECHANICS CO., LTD., Suwon-si (KR)

(72) Inventors: Young Bal Kim, Suwon-si (KR); Wan Soo Kim, Suwon-si (KR); Sang Hoon Kim, Suwon-si (KR)

(73) Assignee: Samsung Electro-Mechanics Co., Ltd., Suwon-si (KR)

( * ) Notice: Subject to any disclaimer, the term of this patent is extended or adjusted under 35 U.S.C. 154(b) by 21 days.

(21) Appl. No.: 15/987,400

(22) Filed: May 23, 2018

(65) Prior Publication Data

US 2019/0036229 A1 Jan. 31, 2019

(30) Foreign Application Priority Data

Jul. 28, 2017 (KR) ..... 10-2017-0096445
Sep. 11, 2017 (KR) ..... 10-2017-0115768

(51) Int. Cl.

| | |
|---|---|
| ***H01Q 21/06*** | (2006.01) |
| ***H01Q 1/38*** | (2006.01) |
| ***H01Q 21/29*** | (2006.01) |
| ***H01Q 1/08*** | (2006.01) |

(52) U.S. Cl.

CPC ..... *H01Q 21/06* (2013.01); *H01Q 1/085* (2013.01); *H01Q 1/38* (2013.01); *H01Q 21/065* (2013.01); *H01Q 21/293* (2013.01); *H01Q 21/062* (2013.01)

(58) Field of Classification Search

CPC ..... H01Q 1/243; H01Q 1/2283; H01Q 1/38; H01Q 21/06; H01Q 21/061; H01Q 21/062; H01Q 21/065

See application file for complete search history.

(56) References Cited

U.S. PATENT DOCUMENTS

| | | | | |
|---|---|---|---|---|
| 7,265,719 | B1 | 9/2007 | Moosbrugger et al. | |
| 9,667,290 | B2 * | 5/2017 | Ouyang | H04B 1/1081 |
| 2005/0264448 | A1 | 12/2005 | Cox et al. | |
| 2012/0235881 | A1 | 9/2012 | Pan et al. | |

(Continued)

FOREIGN PATENT DOCUMENTS

| | | | |
|---|---|---|---|
| CN | 102714001 | A | 10/2012 |
| CN | 103427148 | A | 12/2013 |

(Continued)

OTHER PUBLICATIONS

Chinese Office Action dated May 7, 2020 issued in the corresponding Chinese Patent Application No. 201810783490.5 (14 pages in English, 8 pages in Chinese).

*Primary Examiner* — Robert Karacsony
(74) *Attorney, Agent, or Firm* — NSIP Law

(57) ABSTRACT

An antenna module includes an integrated circuit (IC) that is configured to generate an RF signal, a substrate providing a first surface on which one or more first antenna is arranged, a second surface on which the IC is arranged, and an electrical connection path to the one or more first antenna and the IC, and a flexible substrate connected to the substrate to provide a third surface on which one or more second antenna is arranged and to provide an electrical connection path to the one or more second antenna and the IC.

9 Claims, 9 Drawing Sheets

(56) References Cited

U.S. PATENT DOCUMENTS

| | | | | |
|---|---|---|---|---|
| 2013/0201068 | A1 | 8/2013 | Alexopoulos et al. | |
| 2013/0307736 | A1 | 11/2013 | Larsen et al. | |
| 2016/0308563 | A1 | 10/2016 | Ouyang et al. | |
| 2019/0027808 | A1* | 1/2019 | Mow ..... | H01Q 3/26 |

FOREIGN PATENT DOCUMENTS

| | | | |
|---|---|---|---|
| CN | 103493292 | A | 1/2014 |
| CN | 206301938 | U | 7/2017 |
| KR | 10-2011-0002795 | A | 1/2011 |
| KR | 10-2013-0122688 | A | 11/2013 |
| KR | 10-1502608 | B1 | 6/2015 |
| WO | WO 2011/093151 | A1 | 8/2011 |
| WO | WO 2012/125774 | A2 | 9/2012 |

* cited by examiner

ANTENNA MODULE INCLUDING A FLEXIBLE SUBSTRATE

CROSS-REFERENCE TO RELATED APPLICATIONS

This application claims the benefit under 35 USC 119(a) of Korean Patent Application Nos. 10-2017-0096445 filed on Jul. 28, 2017, and 10-2017-0115768 filed on Sep. 11, 2017, in the Korean Intellectual Property Office, the entire disclosures of the earlier filed applications are incorporated herein by reference for all purposes.

BACKGROUND

1. Field

The present disclosure relates to an antenna module including a flexible substrate.

2. Description of the Background

Recently, millimeter wave (mmWave) communications including fifth generation (5G) communications are being actively studied, and research into the commercialization of a radio frequency (RF) module able to cohesively implement millimeter wave communications is being actively undertaken.

Since millimeter wave communications use a high frequency, a high level of antenna performance has been required. To meet the antenna performance requirements, an antenna may need to have a large size, which in turn may hinder miniaturization of the antenna module.

The above information is presented as background information only to assist with an understanding of the present disclosure. No determination has been made, and no assertion is made, as to whether any of the above might be applicable as prior art with regard to the disclosure.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, an antenna module includes an integrated circuit (IC) configured to generate a radio frequency (RF) signal, a substrate including a first surface on which one or more first antenna is disposed and a second surface on which the IC is disposed, and an electrical connection path to the one or more first antenna and the IC, and a first flexible substrate connected to the substrate and including a third surface on which one or more second antenna is disposed and an electrical connection path to the one or more second antenna and the IC.

The one or more first antenna may be disposed in a n by n array, where n is a natural number of 2 or more, and the one or more second antenna may be disposed in a (n+a) by (n+a) array, where a is a natural number, along with the one or more first antenna.

The third surface may include one or more third antenna including one or more of a dipole antenna and a monopole antenna, and the one or more first antenna may include a patch antenna and the one or more second antenna may include a patch antenna.

The one or more first antenna may include a patch antenna, and the one or more second antenna may include one or more of a dipole antenna and a monopole antenna.

The antenna module may further include a second flexible substrate connected to the substrate and including a fourth surface on which one or more third antenna is disposed and an electrical connection path to the one or more third antenna and the IC.

A thickness of the first flexible substrate may be less than that of the substrate.

The antenna module may further include a set substrate electrically connected to the substrate, and a set module disposed on the set substrate between the set substrate and the first flexible substrate.

The set module may be configured to generate a signal, the set substrate may be configured to transmit the signal to the IC, and the IC may be configured to convert the signal into the RF signal in a millimeter wave (mmWave) band.

The set module may include a DC-DC converter configured to generate power, and the set substrate may transmit the power to the IC.

In another general aspect, an antenna module includes a rigid substrate, an integrated circuit (IC) disposed on the rigid substrate, a first antenna disposed on the rigid substrate connected to the IC, a flexible substrate, and a second antenna disposed on the flexible substrate connected to the IC.

The flexible substrate may extend from the rigid substrate.

The flexible substrate may extend from the rigid substrate in a first direction and may be folded to extend in a second direction.

The first antenna may include one or more of a patch antenna, a dipole antenna, and a monopole antenna.

The second antenna may include one or more of a patch antenna, a dipole antenna, and a monopole antenna.

The flexible substrate may include two or more flexible substrates.

The antenna module may further include a set substrate, and a set module disposed on the set substrate. The rigid substrate may be disposed on the set substrate and the flexible substrate may cover a portion of the set module.

The flexible substrate may include a first flexible substrate disposed to cover a portion of the set module, and a second flexible substrate disposed folded to cover a side portion of the set substrate.

The IC may be disposed on a surface of the rigid substrate opposite to the first antenna. The second antenna may be disposed on a surface of the flexible substrate extending from the surface of the rigid substrate having the first antenna disposed thereon.

One or more of the rigid substrate and the flexible substrate may include an electrical connection to one or more of the IC, the first antenna, and the second antenna.

Other features and aspects will be apparent from the following detailed description, the drawings, and the claims.

BRIEF DESCRIPTION OF DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

An aspect of the present disclosure provides an antenna module having a structure which may be easily miniaturized by arranging a first portion of antennas on a substrate on which integrated circuits (ICs) are arranged and a second portion of the antennas on a flexible substrate.

Figure 1:
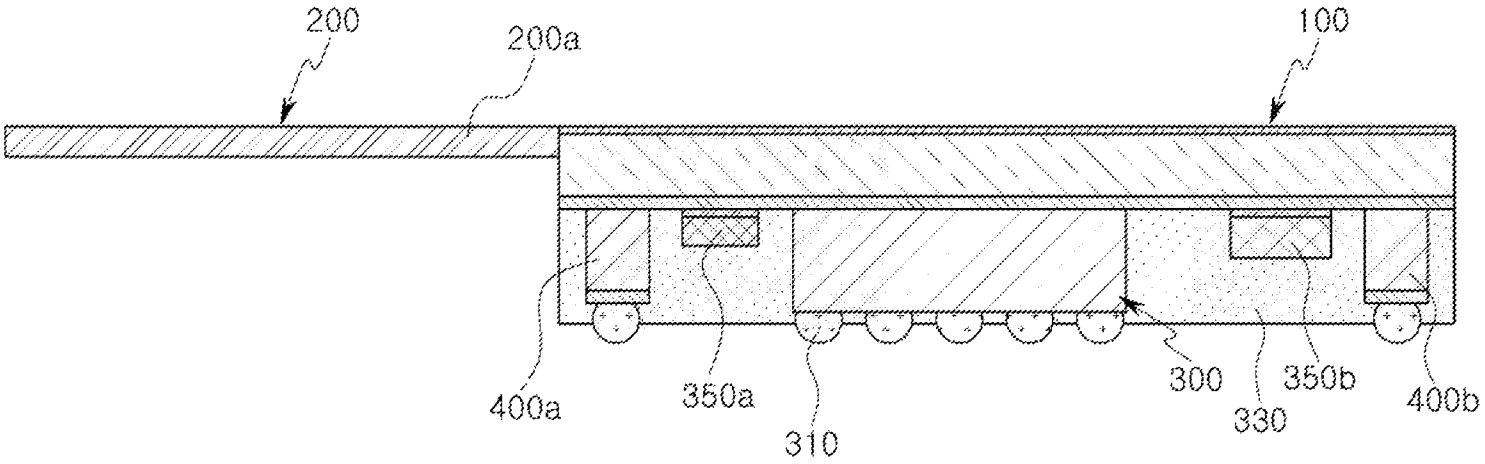
FIG. 1 is a side view illustrating an example of an antenna module including a flexible substrate according to a first embodiment.

FIG. 1 is a side view illustrating an antenna module including a flexible substrate according to a first embodiment.

Referring to FIG. 1, an antenna module including a flexible substrate according to the first embodiment may include a rigid substrate 100, a flexible substrate 200, an integrated circuit (IC) 300, a molding member 330, electronic components 350*a* and 350*b*, and receiving ports 400*a* and 400*b*. The rigid substrate 100 includes main surfaces referred to as a first surface and a second surface spaced apart by side surfaces. The flexible substrate 200 includes main surfaces referred to as a third surface and a fourth surface spaced apart by a thickness of the flexible substrate 200.

For example, the rigid substrate 100 may be formed of one or more of a copper clad laminate (CCL), a glass, ceramic, FR-4, Low Temperature Co-fired Ceramic (LTCC), Bismaleimide Triazine (BT), and prepreg based insulating material depending on required material characteristics. For example, the flexible substrate 200 may be formed of one or more of a polyimide and a liquid crystal polymer (LCP) having higher flexibility than the rigid substrate.

The first surface of the rigid substrate 100 includes a first antenna which receives a radio frequency (RF) signal and transmits the RF signal generated by the IC 300. The IC 300 for generating the RF signal is arranged on the second surface of the rigid substrate 100. The rigid substrate 100 provides an electrical path between the IC 300 and the first antenna.

For example, the rigid substrate 100 has the same structure as a printed circuit board (PCB) and has an antenna region, which provides a boundary condition for an operation of transmitting and/or receiving (transmitting/receiving, hereinafter) the RF signal of the first antenna and a circuit pattern region which provides one or more of a ground region and a power supply region supporting the IC 300.

A second antenna is arranged on the third surface of the flexible substrate 200. The flexible substrate 200 provides an electrical path between the IC 300 and the second antenna.

The flexible substrate 200 is connected to the rigid substrate 100 and may be bent. For example, the flexible substrate 200 has a rigid-flexible substrate structure along with the rigid substrate 100 and provides the boundary condition for the operation of transmitting/receiving the RF signal of the second antenna. The flexible substrate 200 is shown as an extended flexible substrate 200*a* in FIG. 1.

Since the flexible substrate 200 may be less likely to have the circuit pattern region compared to the rigid substrate 100, the thickness of the flexible substrate 200 may be less than that of the rigid substrate 100. Therefore, a space located in a fourth surface direction (a direction generally perpendicular to the fourth surface) of the flexible substrate 200 may be further secured by a thickness of the circuit pattern region of the rigid substrate 100. That is, the space covered by the extended flexible substrate 200*a* shown in FIG. 1 is also bordered on a side by the adjacent rigid substrate 100 and the circuit pattern.

The IC 300 may be configured to generate the RF signal and receive the RF signal received through the first and second antennas. For example, the IC 300 is configured to generate the RF signal through the first and second antennas, the IC 300 is configured to receive the RF signal through the first and second antennas, or the IC 300 is configured to both generate and receive the RF signal through the first and second antennas. For example, the IC 300 receives a low frequency signal through the receiving ports 400*a* and 400*b*, and performs one or more of a frequency conversion, amplification, a filtering phase control, and a power generation on the low frequency signal.

For example, the IC 300 is electrically connected to the rigid substrate 100 through a solder ball and is stably arranged on the rigid substrate 100 through a resin. In addition, the IC 300 may be electrically connected to an outside, another module, or another substrate through the solder ball 310.

The molding member 330 may be surrounded by an epoxy molding compound (EMC) to protect the IC 300 from the external environment. The molding member 330 may be omitted for reasons such as the ambient environment of the antenna module.

The electronic components 350*a* and 350*b* provide one or more of a resistance value, capacitance, and inductance to the IC 300. For example, the electronic components 350*a* and 350*b* can include a multilayer ceramic capacitor (MLCC). The electronic components 350*a* and 350*b* can be arranged in the space located in the second surface direction (a direction generally perpendicular to the second surface) of the rigid substrate 100 as shown in FIG. 1. The electronic components 350*a* and 350*b* can be arranged in the space located in the fourth surface direction of the flexible substrate 200. The electronic components 350*a* and 350*b* can be arranged in the space located in the second surface direction of the rigid substrate 100 and in the fourth surface direction of the flexible substrate 200. However, the disclosure is not so limited and the electronic components 350*a* and 350*b* may additionally or alternatively be disposed in the first and third surface directions as well.

The receiving ports 400*a* and 400*b* can receive the low frequency signal and/or power, and transmit the low frequency signal and power to the IC 300. For example, the receiving ports 400*a* and 400*b* have the same structure as the printed circuit board (PCB), are electrically connected to the rigid substrate 100 by the solder ball, and are stably arranged on the rigid substrate 100 through the resin 330.

The receiving ports 400*a* and 400*b* may have a connector shape to be coupled to an outside, another module, or another substrate in a wired manner, and may be electromagnetically coupled to an outside, another module, or another substrate.

Figure 2:
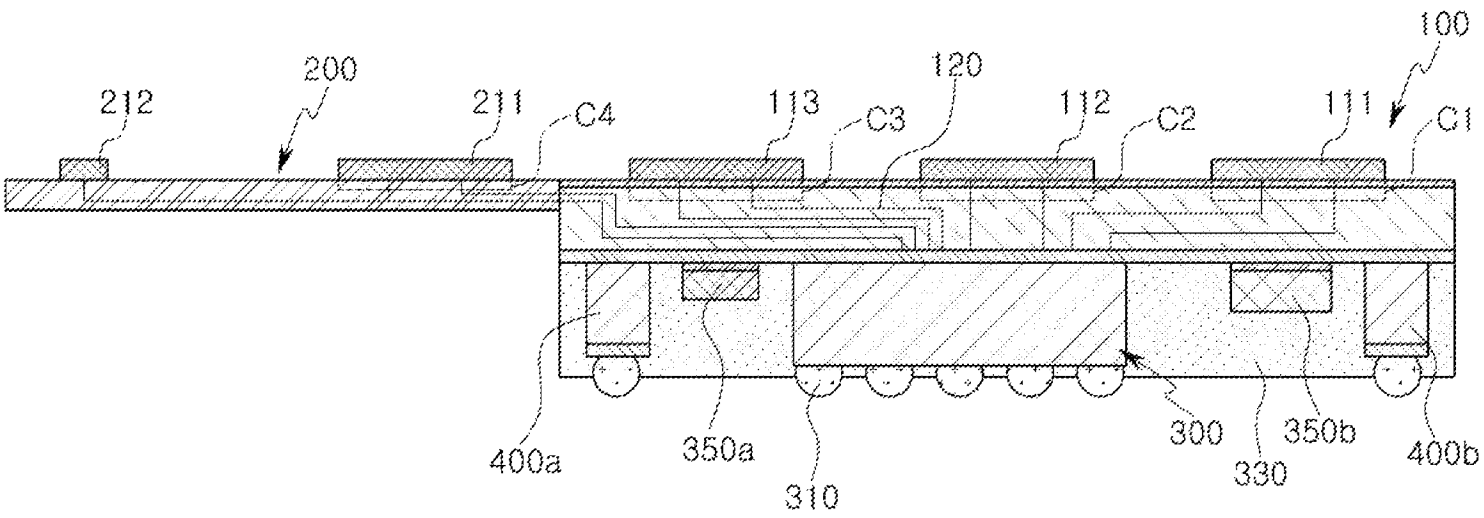
FIG. 2 is a side view illustrating an example of additional detail of the antenna module including the flexible substrate of FIG. 1.

FIG. 2 is a side view illustrating an example of additional detail of the antenna module including the flexible substrate of FIG. 1.

Referring to FIG. 2, the rigid substrate 100 on which the first antennas 111, 112, and 113 are arranged and the flexible substrate 200 on which second antennas 211 and 212 are arranged includes feed lines 120, and cavities C1, C2, C3, and C4.

The feed lines 120 each electrically connect the corresponding first or second antenna to the IC 300.

The cavities C1, C2, C3, and C4 provide boundary conditions for the operation of transmitting and receiving the RF signal of the corresponding first or second antenna. For example, the boundaries of the cavities C1, C2, C3, and C4 may be surrounded by a ground layer, a plating layer, or a via, and the ground layer may not be substantially disposed inside the cavities C1, C2, C3, and C4.

The cavities C1, C2, C3, and C4 may be omitted depending on the type of the corresponding first or second antenna. For example, the cavities C1, C2, C3, and C4 may not be formed in a region where a dipole antenna or a monopole antenna is arranged in the rigid substrate 100 or the flexible substrate 200.

Figure 3:
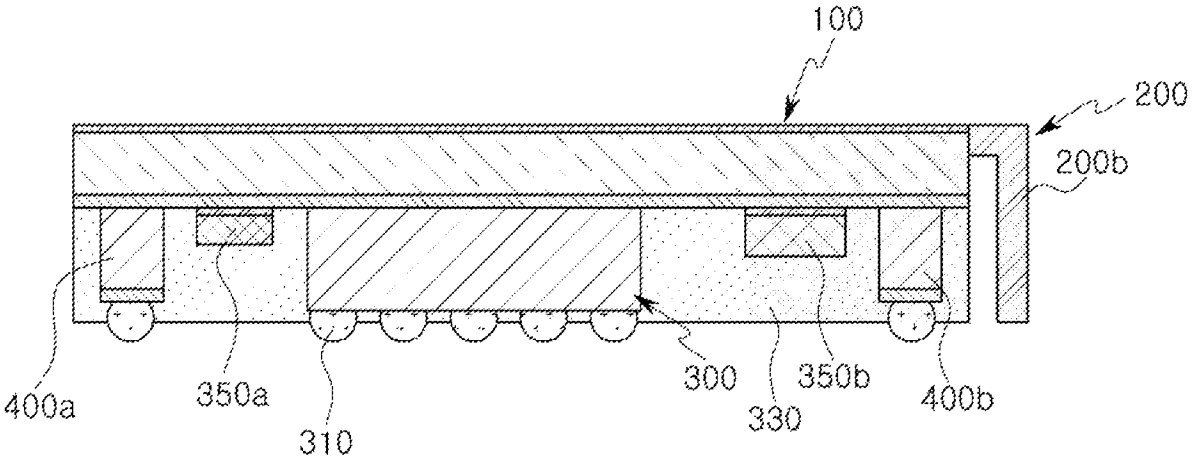
FIG. 3 is a side view illustrating an example of a folded form of a flexible substrate in an example of an antenna module according to a second embodiment.

FIG. 3 is a side view illustrating an example of a folded form of a flexible substrate in an example of an antenna module according to a second embodiment.

Referring to FIG. 3, the flexible substrate 200 is folded so that the third surface faces a side direction of the rigid substrate 100. A side direction of the rigid substrate 100 may be a direction generally perpendicular to the side of the rigid substrate 100 as shown in FIG. 3, or in any other direction at an angle to the first surface direction of the rigid substrate 100. The folded flexible substrate 200*b* is shown connected to the rigid substrate 100.

Thus, a side space of the rigid substrate 100 is ensured, that is, a space adjacent the rigid substrate 100 may be covered and any second antennas 211, 212 disposed on the third surface of the flexible substrate 200 may transmit and/or receive (hereinafter, transmit/receive) in a different direction from first antennas 111, 112, 113 disposed on the first surface of the rigid substrate 100. Thus, a transmission and/or reception (hereinafter transmission/reception) direction of the first and second antennas 111, 112, 113, 211, 212 may be enlarged.

Figure 4:
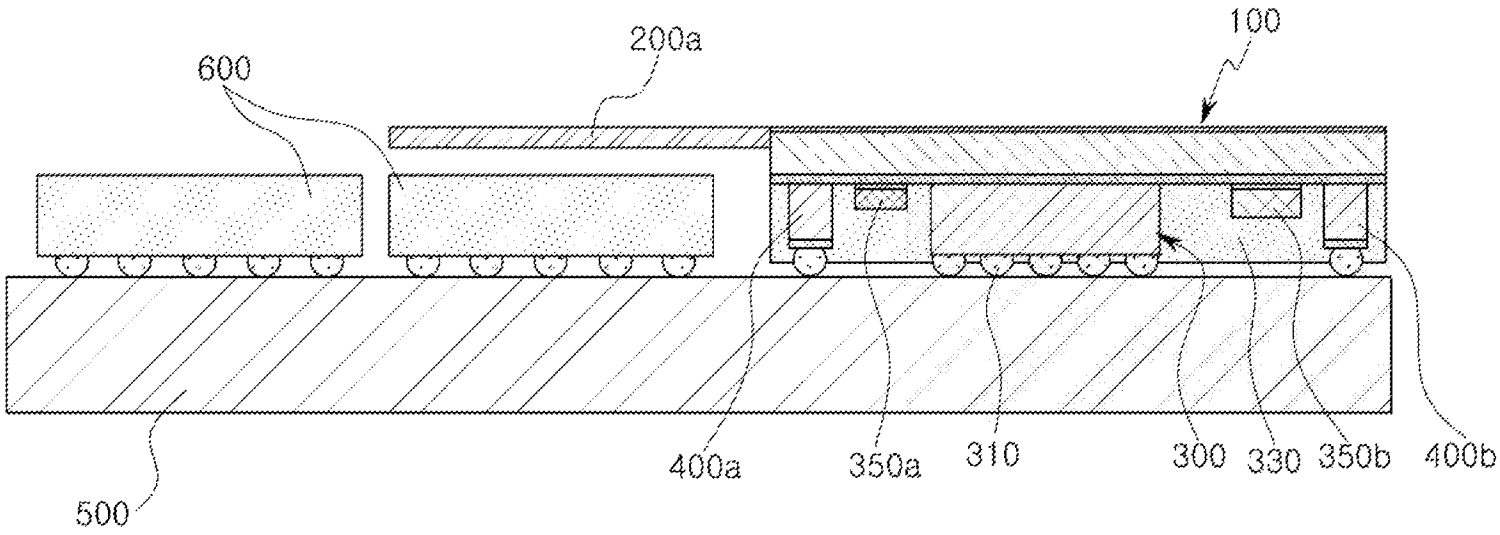
FIG. 4 is a side view illustrating an example of space utilization of the antenna module including the flexible substrate according to the first embodiment shown in FIG. 1.

FIG. 4 is a side view illustrating an example of space utilization of the antenna module including the flexible substrate according to the first embodiment shown in FIG. 1.

Referring to FIG. 4, the rigid substrate 100 is disposed on a set substrate 500 through the receiving ports 400*a* and 400*b*.

The set substrate 500 provides an electrical path between a set module 600 and the IC 300.

One or more set module 600 is arranged on the set substrate 500.

The set module 600 may generate the low frequency signal, the power provided to the IC 300, and/or at least some of the resistance value, the capacitance, and the inductance to the IC 300. For example, the set module 600 includes a circuit to perform amplification, filtering, a frequency conversion, and an analog-to-digital conversion on a baseband signal or an intermediate frequency (IF) signal and includes a DC-DC converter to generate power. For example, the IC 300 receives a signal, which is amplified, filtered and/or converted by the set module 600, through the set substrate 500, and converts the received signal into a millimeter wave (mmWave) band RF signal.

The flexible substrate 200 may be disposed in a space on the set module 600. That is, the flexible substrate 200 may secure the arrangement space where the set module 600 is disposed while providing the arrangement space for the second antenna 211, 212. For example, the flexible substrate 200 covers the set module 600 disposed on the set substrate 500 in the fourth surface direction of the flexible substrate 200 and the second antennas 211, 212 are disposed on the third surface of the flexible substrate 200.

When the arrangement space for the set module 600 is large, some of the operations performed by the IC 300 may be instead performed by the set module 600, and the influence of heat, noise, and the like generated due to the operation of the set module 600 on the IC 300 or the first and second antennas may also be reduced.

That is, the antenna module including the flexible substrate according to the example embodiments, not only has a structure that may be easily miniaturized, but may also improve the performance of the antenna.

Figure 5:
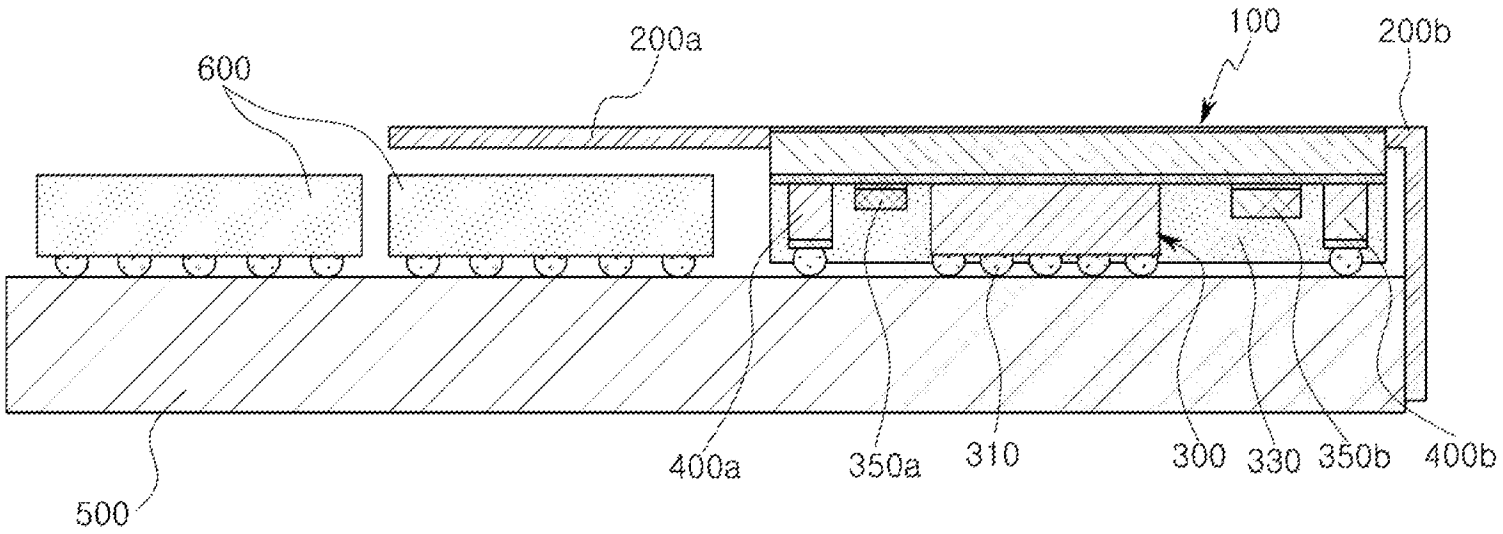
FIG. 5 is a side view illustrating an example of space utilization of an antenna module including two or more flexible substrates according to a third embodiment.

FIG. 5 is a side view illustrating an example of space utilization of an antenna module including a plurality of flexible substrates according to a third embodiment.

Referring to FIG. 5, the antenna module including the flexible substrate according to the third embodiment includes two or more flexible substrates. For example, the extending flexible substrate 200*a* and the folded flexible substrate 200*b* as described above in the first and second embodiments are used in the third embodiment of the antenna module. Accordingly, the antenna module including the flexible substrate has the structure that is easily miniaturized, improves the performance of the antenna, and enlarges the transmission/reception direction of the antenna.

Figure 6:
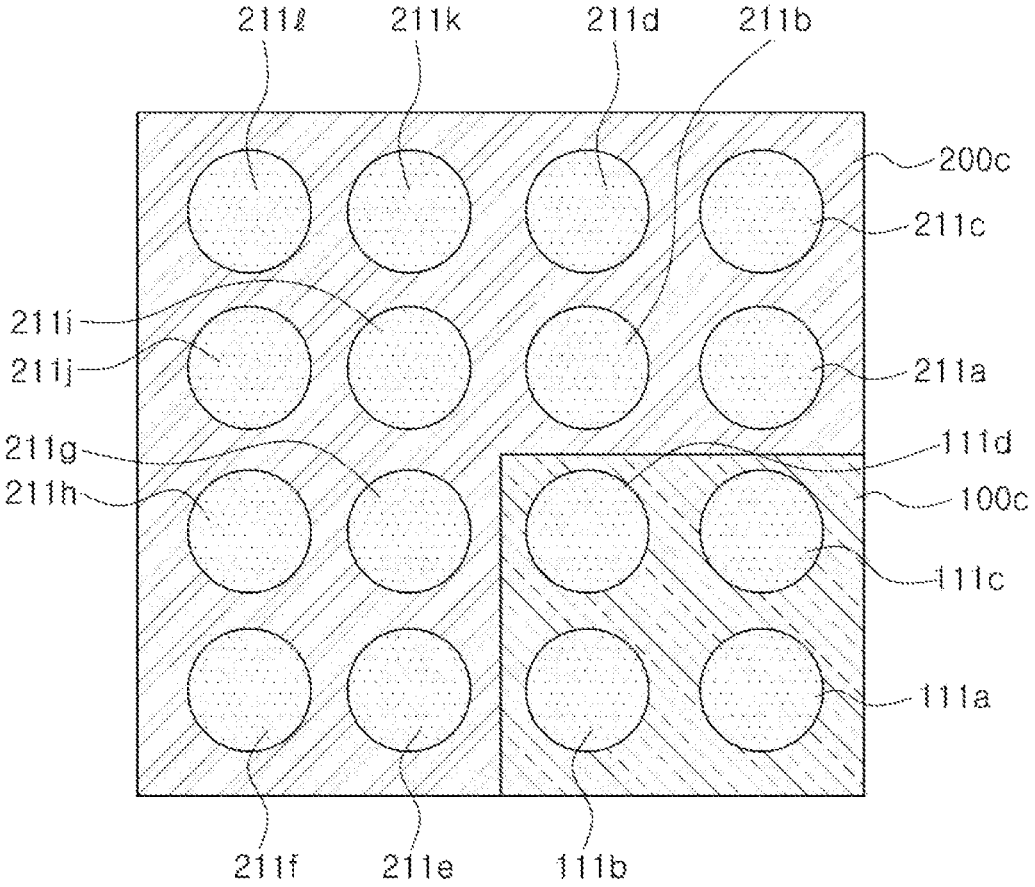
FIG. 6 is a plan view illustrating an example of a first form of an antenna arrangement of the antenna module including the flexible substrate according to the first embodiment shown in FIG. 1.

FIG. 6 is a plan view illustrating an example of a first form of an antenna arrangement of the antenna module including the flexible substrate according to the first embodiment of FIG. 1.

Referring to FIG. 6, first antennas 111*a*, 111*b*, 111*c*, and 111*d* have a structure of a patch antenna and are arranged on a first surface of a rigid substrate 100*c*.

Second antennas 211*a*, 211*b*, 211*c*, 211*d*, 211*e*, 211*f*, 211*g*, 211*h*, 211*i*, 211*j*, 211*k*, and 211*l* have the structure of the patch antenna and are arranged on a third surface of a flexible substrate 200*c*. Here, a space on a fourth surface of the flexible substrate 200*c* is secured.

For example, the first antennas 111*a*, 111*b*, 111*c*, and 111*d* are arranged in a form of n by n, where n is a natural number of 2 or more, and the second antennas 211*a*, 211*b*, 211*c*, 211*d*, 211*e*, 211*f*, 211*h*, 211*i*, 211*j*, 211*k*, and 211*l* are arranged in a form of (n+a) by (n+a), where a is a natural number, along with the first antennas 111*a*, 111*b*, 111*c*, and 111*d*.

A patch antenna has a greater size in a horizontal direction compared to a dipole antenna or a monopole antenna, but has a higher level of performance compared to the dipole antenna or the monopole antenna.

The antenna module including the flexible substrate according to the first, second, and third embodiments secures a space for other components, for example, a set module 600 and an electronic component 350*a*, 350*b* to be disposed while accommodating a large size patch antenna, thereby improving the performance of the antenna and downsizing the antenna.

In these embodiments, the patch antenna may have a circular shape or a polygonal shape, but the shape of the patch antenna is not particularly limited thereto.

Figure 7:
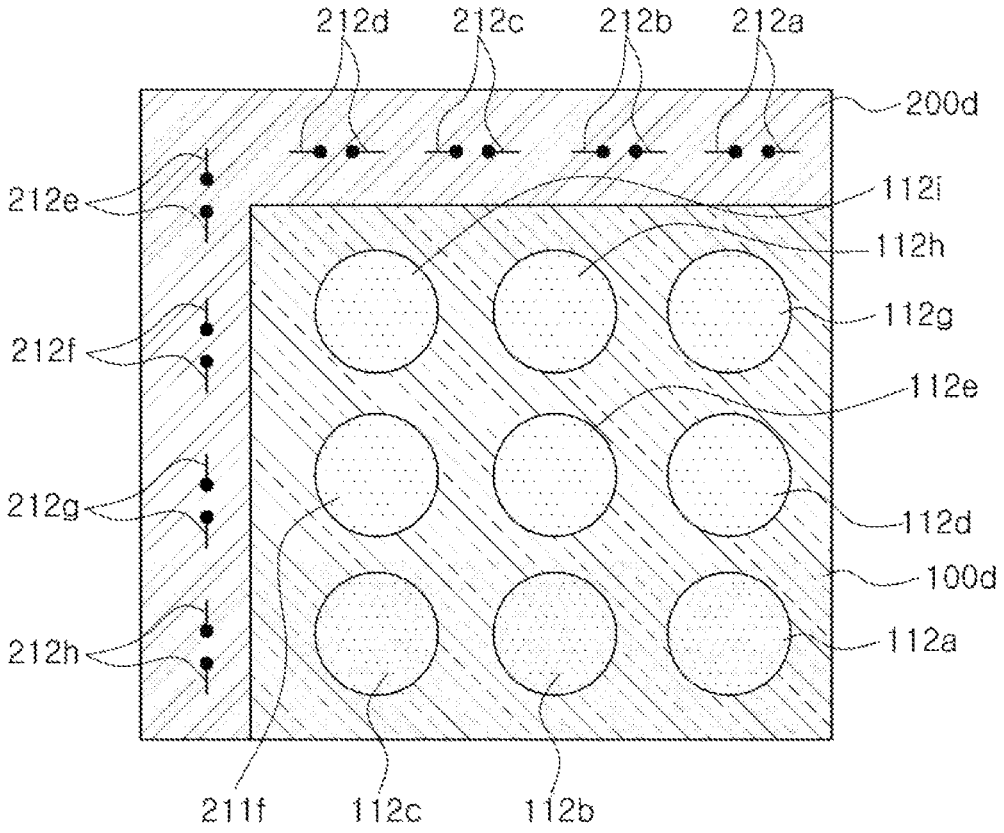
FIG. 7 is a plan view illustrating an example of a second form of an antenna arrangement of the antenna module including the flexible substrate according to the second embodiment shown in FIG. 3.

FIG. 7 is a plan view illustrating a second form of an antenna arrangement of the antenna module including the flexible substrate according to the second embodiment of FIG. 3.

Referring to FIG. 7, first antennas 112*a*, 112*b*, 112*c*, 112*d*, 112*e*, 112*f*, 112*g*, 112*h*, and 112*i* have the structure of the patch antenna and are arranged on a first surface of a rigid substrate 100*d*.

Second antennas 212*a*, 212*b*, 212*c*, 212*d*, 212*e*, 212*f*, 212*g*, and 212*h* have the structure of a dipole antenna or a monopole antenna and are arranged on a third surface of a flexible substrate 200*d*. Here, the flexible substrate 200*d* is folded.

Figure 8:
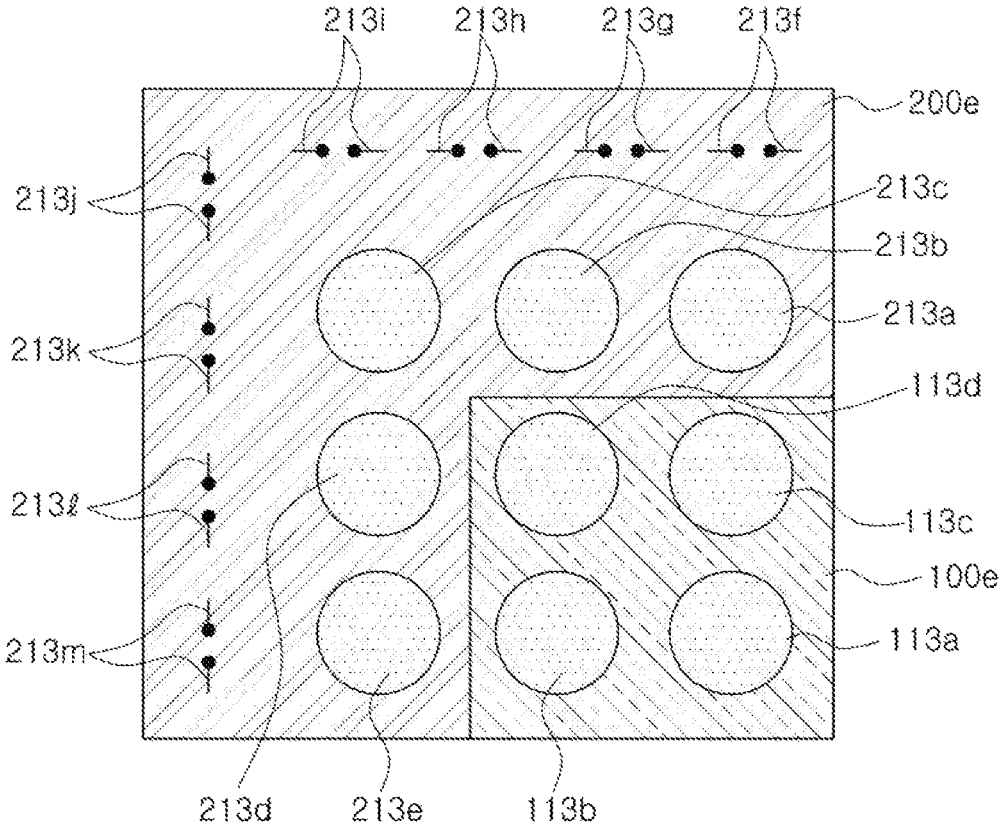
FIG. 8 is a plan view illustrating an example of a third form of an antenna arrangement of the antenna module including the flexible substrate according to the first embodiment shown in FIG. 1.

FIG. 8 is a plan view illustrating an example of a third form of an antenna arrangement of the antenna module including the flexible substrate according to the first embodiment of FIG. 1 or the second embodiment of FIG. 3.

Referring to FIG. 8, first antennas 113*a*, 113*b*, 113*c*, and 113*d* have the structure of a patch antenna and are arranged on a first surface of a rigid substrate 100*e*.

Some of the second antennas 213*a*, 213*b*, 213*c*, 213*d*, 213*e*, 213*f*, 213*g*, 213*h*, 213*i*, 213*j*, 213*k*, 213*l*, and 213*m* have the structure of the patch antenna, and some thereof have the structure of a dipole antenna or a monopole antenna.

In the flexible substrate 200*e*, at a space between the region where the patch antennas are arranged and the region where the dipole antennas are arranged is folded in accordance with the second embodiment. Whereas, in the first embodiment, the flexible substrate 200*e* is not folded at the space between the region where the patch antennas are arranged and the region where the dipole antennas are arranged.

Figure 9:
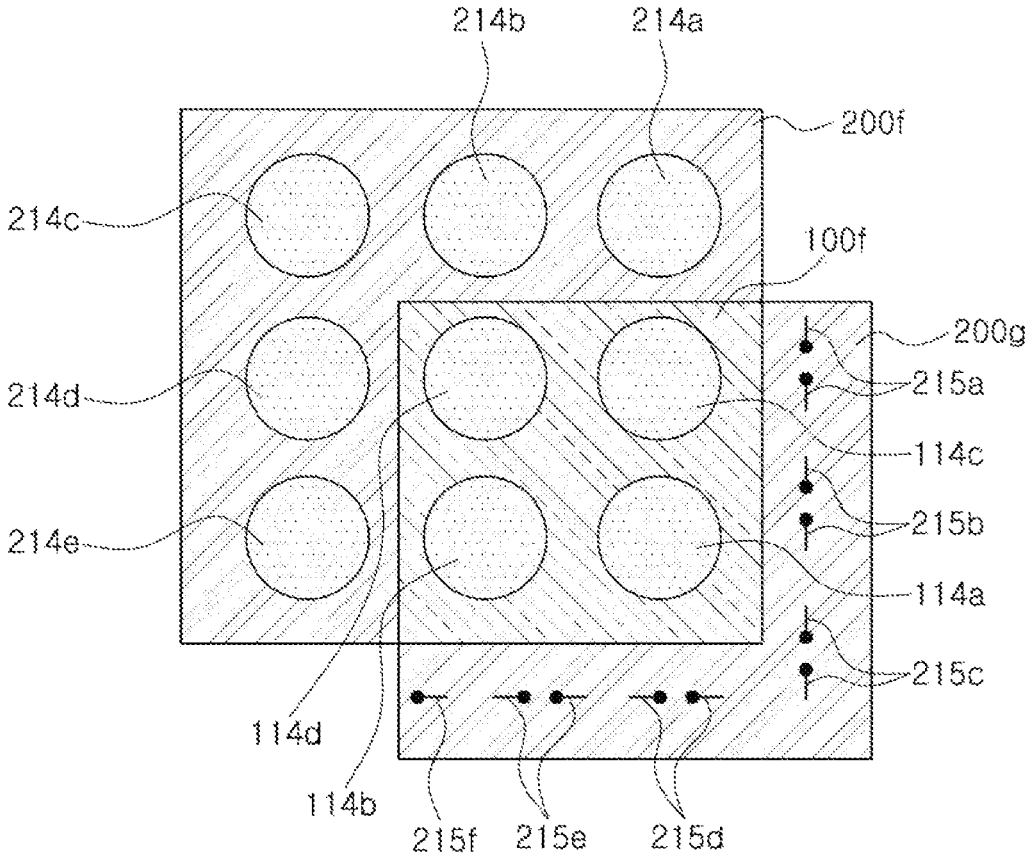
FIG. 9 is a plan view illustrating an example of a fourth form of an antenna arrangement of the antenna module including the flexible substrate according to the third embodiment shown in FIG. 5.

FIG. 9 is a plan view illustrating an example of a fourth form of the antenna arrangement of the antenna module including the flexible substrate according to the third embodiment of FIG. 5.

Referring to FIG. 9, first antennas 114*a*, 114*b*, 114*c*, and 114*d* have the structure of patch antennas and are arranged on a first surface of a rigid substrate 100*f*.

A first portion of the second antennas 214*a*, 214*b*, 214*c*, 214*d*, and 214*e* are arranged on a third surface of a first flexible substrate 200*f* and have the structure of the patch antenna.

A second portion of the second antennas 215*a*, 215*b*, 215*c*, 215*d*, 215*e*, and 215*f* are arranged on a fifth surface of the second flexible substrate 200*g* and have the structure of the dipole antenna or the monopole antenna.

One or more of the first flexible substrate 200*f* and the second flexible substrate 200*g* is folded and the space on a fourth surface of the first flexible substrate 200*f* or on the sixth surface of the second flexible substrate 200*g* is secured.

As set forth above, according to the first, second, and third example embodiments, the antenna module has a structure which can be easily miniaturized by arranging a portion of the antennas on the substrate on which the ICs are arranged and another portion of the antennas on the one or more flexible substrate.

In addition, the antenna module according to these example embodiments increases the transmission/reception direction of the antenna compared to an antenna of an antenna module without the flexible substrate, such as an antenna of an antenna module with a rigid substrate.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An antenna module, comprising:

an integrated circuit (IC) configured to generate a radio frequency (RF) signal;

a substrate comprising a first surface on which at least one first antenna is disposed, a second surface on which the IC is disposed such that a portion of the at least one first antenna overlaps the IC, and an electrical connection path to the at least one first antenna and the IC;

a first flexible substrate connected to the substrate, and comprising a third surface on which at least one second antenna is disposed and an electrical connection path to the at least one second antenna and the IC;

a set substrate electrically connected to the substrate; and a set module disposed on the set substrate between the set substrate and the first flexible substrate, wherein the set module is configured to generate a signal, wherein the set substrate is configured to transmit the signal to the IC, and wherein the IC is configured to convert the signal into the RF signal in a millimeter wave (mmWave) band.

2. The antenna module of claim 1, wherein the at least one first antenna is disposed in an n by n array, where n is a natural number of 2 or more, and wherein the at least one second antenna is disposed in an (n+a) by (n+a) array along with the at least one first antenna, where a is a natural number.

3. The antenna module of claim 2, wherein the third surface comprises at least one third antenna comprising one or more of a dipole antenna and a monopole antenna, and wherein the at least one first antenna comprises a patch antenna and the at least one second antenna comprises a patch antenna.

4. The antenna module of claim 1, wherein the at least one first antenna comprises a patch antenna, and wherein the at least one second antenna comprises one or more of a dipole antenna and a monopole antenna.

5. The antenna module of claim 1, further comprising:

a second flexible substrate connected to the substrate, and comprising a fourth surface on which at least one third antenna is disposed and an electrical connection path to the at least one third antenna and the IC.

6. The antenna module of claim 5, wherein the at least one first antenna and the at least one second antenna each comprise a patch antenna, and wherein the at least one third antenna comprises one or more of a dipole antenna and a monopole antenna.

7. The antenna module of claim 1, wherein a thickness of the first flexible substrate is less than a thickness of the substrate.

8. An antenna module, comprising:

an integrated circuit (IC) configured to generate a radio frequency (RF) signal:

a substrate comprising a first surface on which at least one first antenna is disposed, a second surface on which the IC is disposed such that a portion of the at least one first antenna overlaps the IC, and an electrical connection path to the at least one first antenna and the IC:

a first flexible substrate connected to the substrate, and comprising a third surface on which at least one second antenna is disposed and an electrical connection Path to the at least one second antenna and the IC;

a set substrate electrically connected to the substrate; and a set module disposed on the set substrate between the set substrate and the first flexible substrate, wherein the set module comprises a DC-DC converter configured to generate power, and wherein the set substrate is configured to transmit the power to the IC.

9. An antenna module, comprising:

an integrated circuit (IC) configured to generate a radio frequency (RF) signal;

a substrate comprising a first surface on which at least one first antenna is disposed, a second surface on which the IC is disposed, and an electrical connection path to the at least one first antenna and the IC;

a first flexible substrate connected to the substrate, and comprising a third surface on which at least one second antenna is disposed and an electrical connection path to the at least one second antenna and the IC;

a set substrate electrically connected to the substrate; and a set module disposed on the set substrate between the set substrate and the first flexible substrate, wherein the set module is configured to generate a signal or a power, and wherein the set substrate is configured to transmit the signal or the power to the IC.

* * * * *